United States Patent [19]

Beard

[11] 4,450,985

[45] May 29, 1984

[54] RECLOSABLE VALVE WITH SEPARATE INTERNAL SEAL MEANS AND SEAL REMOVING MEANS THEREFOR

[76] Inventor: Walter C. Beard, South St., Middlebury, Conn. 06762

[21] Appl. No.: 442,636

[22] Filed: Nov. 18, 1982

[51] Int. Cl.[3] ..... B65D 83/14

[52] U.S. Cl. ..... 222/402.22; 222/402.21; 222/83.5; 222/541

[58] Field of Search ..... 222/402.1, 402.21, 402.22, 222/518, 541, 83.5, 88, 81, 83, 402.23, 394

[56] References Cited

U.S. PATENT DOCUMENTS

| | | | |
|---|---|---|---|
| 2,667,991 | 2/1954 | Boyer | 222/82 |
| 2,709,111 | 5/1955 | Green . | |
| 2,731,298 | 1/1956 | Green . | |
| 2,774,432 | 12/1956 | Danziger . | |
| 3,060,965 | 10/1962 | Taggart . | |
| 3,214,063 | 10/1965 | Wallis | 222/541 X |
| 3,441,177 | 4/1969 | Treharne, Jr. . | |
| 3,547,405 | 12/1970 | Ewald | 251/354 |
| 3,635,379 | 1/1972 | Angele . | |
| 4,137,930 | 2/1979 | Scholle | 222/83 X |

*Primary Examiner*—Joseph J. Rolla
*Assistant Examiner*—Thomas C. Fitzgerald
*Attorney, Agent, or Firm*—Hill, Van Santen, Steadman & Simpson

[57] ABSTRACT

A reclosable moveable valve stem actuated valve structure for an aerosol-type viscous fluid dispensing container. The valve structure is provided with an initially sealed internal seal and a valve stem operated internal seal removing component. The valve structure is preassembled before association with the container. The seal includes a seal plate and releasable bond. The seal removing component is associated with a moveable valve member. The moveable valve member is operated initially by movement of the moveable valve stem and causes the internal seal removing component to effectuate a release of the releasable bond, thereby opening the initially sealed internal seal.

30 Claims, 18 Drawing Figures

RECLOSABLE VALVE WITH SEPARATE INTERNAL SEAL MEANS AND SEAL REMOVING MEANS THEREFOR

BACKGROUND THE INVENTION

1. Field of the Invention

This invention lies in the field of valves actuated by stem movements and particularly to combinations in such valves of separate internal seal means and seal remaining means therefor.

2. Description of the Prior Art

In the art of aerosol-type valves, it is common for a reclosable valve assembly to be operated during opening and closing by means of the movement of the valve stem through application thereto of an appropriately applied external force, as from an operator's finger. Typically during operation, such a valve stem is linearly displaced (e.g., tilted or reciprocated) relative to its normally (typically upright) closed axially aligned position.

Especially when the fill of a pressurized container that is functionally associated with such a valve assembly (as the dispensing means) is sensitive to, or reactive with oxygen, water vapor, or other substances found in the atmospheric environment, it would be desirable to seal internally and hermetically the valve assembly (relative to the fill in the container) until such time as the fill is to be dispensed and used. At such time, it would be desirable to remove the seal permanently by means of valve stem actuation after which the reclosable valve assembly can be opened and closed in typical fashion for dispensing the fill.

So called one-shot container and valve device assemblies for use as fire extinguishers and the like have heretofore been provided (see, for examples, Danziger U.S. Pat. No. 2,774,432 and Treharne, Jr. U.S. Pat. No. 3,441,177), but, once the internal seal is broken, these assemblies are designed to operate without interruption to discharge the entire fill; no reclosable valve feature is provided.

The Danziger and Treharne, Jr. devices each employ frangible plates which are ruptured in an initial valve opening operation. Frangible plates have the inherent disadvantage that vibration or shock to the initially sealed valve assembly (as when such assembly is in combination with a container holding a pressurized fill) can cause undesired and unintended premature frangible plate rupture.

To redesign the Danziger and Treharne, Jr. devices so as to provide a reclosable valve in combination with such a frangible sealing plate does not appear to be practical since obviously fractured pieces of the frangible sealing plate would become lodgable in the valve so that reclosing of the valve could not be reliably accomplished.

Boyer U.S. Pat. No. 2,667,991 teaches a valve structure provided with an internal sealing plate which is pierced at a single local point by a needle-like projection which is moved against the seal by external movement of a valve stem. The valve plate is otherwise left intact requiring that the entire fill must be pushed through the pin hole in the valve plate. Such an arrangement makes high flow capacity for a viscous fill through the valve from the container interior substantially impossible.

Thus, so far as is now known, reclosable high flow capacity valve assemblies of the type operatable by linear-type valve stem movement have not previously been known which were provided with separate internal seal means and seal removing or opening means operated by valve stem movement.

Previously, I have invented a class of reclosable valves operated by valve stem tilting which are provided with an internal diaphragm-type seal which is severed by a cutting action associated with valve stem tilting in an initial use operation; see Beard U.S. patent application Ser. No. 405,696, filed Aug. 3, 1982.

BRIEF SUMMARY OF THE INVENTION

By the present invention, there is provided a class of stem equipped, reclosable valve assemblies of the type operated by valve stem movement wherein each valve assembly is provided with internal sealing plate means, releasable bonding means, and seal removing means therefor. The internal sealing plate means is initially secured to a valve body portion by the releasable bonding means which initially secures and maintains such sealing plate means in a gas tight relationship to such valve body portion. The seal removing means includes a cam member which is moved against such sealing plate means through movement of the valve stem to break or part such releasable bonding means and thereby separate such sealing plate means from such valve body portion and permit a pressurized fill to be dispensed from an associated container through the reclosable valve assembly during valve opening.

The present invention provides in one aspect a significant advance in the art of aerosol-type valves by providing the capacity for long shelf-like storage of fills sensitive to atmospheric gases (including moisture) with an improved internal seal.

In another aspect, the present invention provides a reclosable valve assembly which, after an internal seal is ruptured, can be opened and closed at will by a valve user.

Another aspect of this invention is to provide a reclosable valve structure for pressurizable containers and the like which valve structure incorporates initially an internal seal means and externally operated internal seal removing means and which valve structure can be preassembled, then bulk stored with other such structures in a common container, and next mounted on such a container followed by container charging, generally without any substantial danger to the internal seal means and the seal removing means in such process.

In another aspect, the present invention provides an internally sealed, stem-equipped valve assembly which is characterized by substantial freedom from the possibility of seal rupture from vibration, shock, aging, etc. particularly when the valve assembly is in functional association with a container that has been charged with a pressurized fill, so that the pressurized vessel contents tends to aid in holding the sealing means in a normally sealed relationship with associated components.

In another aspect, the present invention provides a stem-equipped valve assembly with internal sealing means comprised of a sealing plate means and a releasable bonding means for such sealing plate means which sealing means is unsealed by rupturing such bonding means through movement of the valve stem.

In another aspect, the present invention provides an internal sealing means which is opened by valve stem movement and which, once opened, produced substantially no debris, as from frangible disk breakage, which can interfere with normal valve opening and closing operations.

In another aspect, the present invention provides a reclosable valve with a separate internal seal means and seal removal means therefor which valve is characterized by a capacity for very large flow therethrough after the seal means is removed by operation of such seal removal means.

Other and further aspects, aims, objects, features, advantages, embodiments, uses, and the like will be apparent to those skilled in the art from the present specification taken with the accompanying drawings.

DETAILED DESCRIPTION

Figure 1:
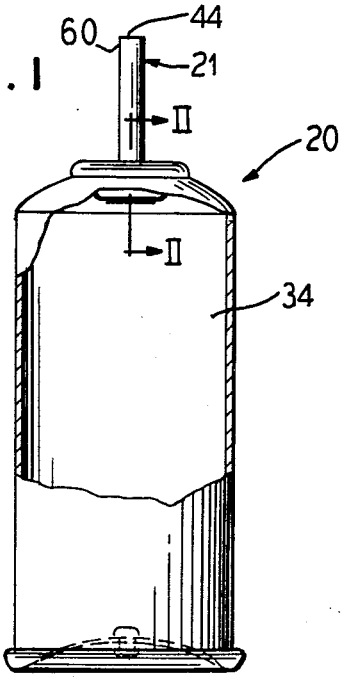
FIG. 1 is a fragmentary view of an aerosol-type container associated functionally with a valve assembly of the present invention.
Figure 2:
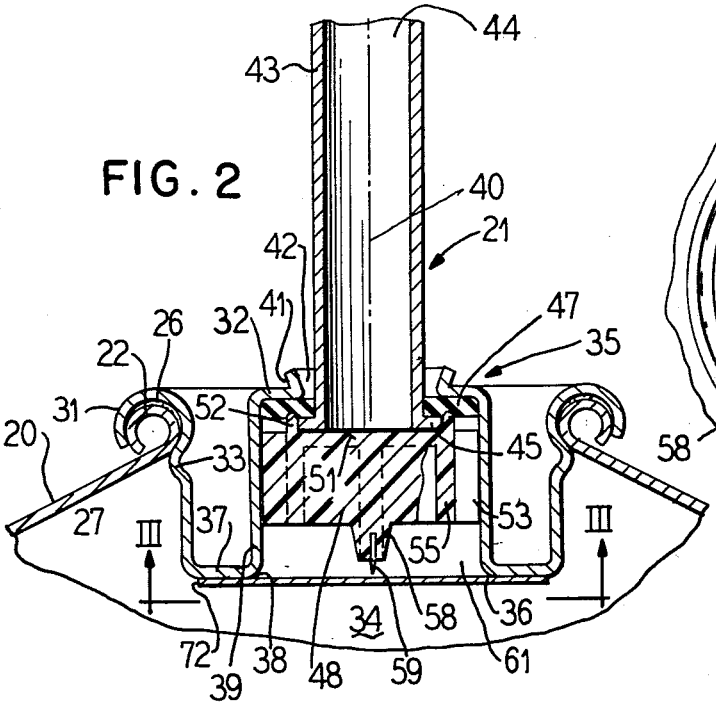
FIG. 2 is an enlarged vertical sectional view taken along the line II—II of FIG. 1 illustrating components of one embodiment of a valve assembly of the present invention.
Figure 3:
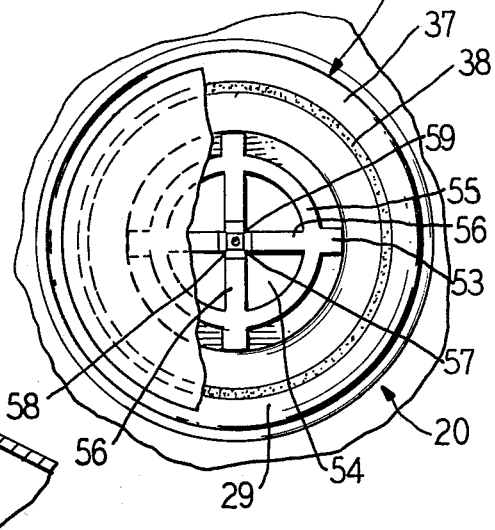
FIG. 3 is a view taken along the line III—III of FIG. 2 illustrating a bottom view of the valve structure of FIG. 2 with some parts thereof broken away.

Referring to FIGS. 1–3, a dispensing container or can 20 shown fragmentarily is fitted on its top end with a tilt valve structure 21 of the present invention. Container 20 is provided with an axially located aperture 27 having a rolled perimeter 22, container 20 being formed in this instance of sheet metal.

Container 20 is of conventional construction and forms no part of the present invention as such.

The tilt valve structure 21 includes a metallic mounting cup 29 which terminates in a rolled perimeter 31 that is adapted to make nesting engagement with the rolled perimeter 22. Interior surfaces of the roll 31 are provided with a coating 26 formed of a sealing material of resilient, elastomeric plastic composition, such as a chloroprene rubber composition, or the like, so that, when the mounting cup 29 is fitted over the roll 22 and formed by collet fingers, there is produced a retaining crimp 33 in cup 29, and the preformed valve structure 21 is thus sealingly associated with the container 20. Charging of container 20 with a pressurized fill is conventionally accomplished, as those skilled in the art will readily appreciate.

While the valve structure 21 is particularly well suited for the dispensing of a viscous fluid from a chamber 34 of the container 20, the valve structure 21, as those skilled in the art will readily appreciate, is also suitable for the dispensing of a viscous fluid which has admixed therewith a gaseous propellent. When pressurized fluid material in, or dispensed from, the chamber 34 can react with oxygen, water vapor, or other substance in the atmosphere, or when such material can react with components of the valve structure 21 housed in the central portion 35 of the cup 29, a problem arises, particularly when the assembly of valve structure 21 and container 20 is to be stored for a period of time before use after such material has been introduced into the chamber 34.

To overcome this problem, a seal plate 36 is positioned across the bottom or interior projections 37 of mounting cup 29 and such seal plate 36 is adhered to such projections 35 by releasable bonding means 38. Each of the seal plate 36 and the releasable bonding means 38 are gas tight so as to provide in combination with projections 37 and cup 29 a hermetic seal. The releasable bonding means 38, however, provides a releasable or separatable attachment operating to separate, or remove, in response to a force applied thereto in a direction generally urging apart the seal plate 36 from the projections 37, the seal plate 36 from its initial adjacent association with the projections 37 in the assembled valve structure 21. The separation can be accomplished by a fracture of the bonding means 38 itself, or by a breaking away of the bonding means 38 from one or the other of the seal plate 36 or the projections 37, some combination thereof, or otherwise, desired. Such a separation (or rupture) is accomplished at the time when the valve structure 21 is to be first used for the dispensing of pressurized material from chamber 34 of container 20.

The releasable bonding means 38, in general, can be provided by any convenient or suitable system, the exact choice in any given instance being influenced by cost factors, functional requirements of a particular application, and the like. The releasable bonding means 38 thus can be comprised of, for examples, (a) a nonmetallic adhesive which is organic or inorganic in composition, (b) a metallic bond, such as a hairline weld, soldered joint, or the like, (c) a gasket, such as one forming a friction fit between the seal plate 36 and the projections 37 or the like, or (d) some combination of the foregoing, or the like, as desired.

In general, the seal plate 36 can be comprised of any convenient solid material which will suitably withstand the pressured within the chamber 34 in a filled and pressured container 20 and which will not rupture or crack during normal storage of a filled and pressured container 20. A presently preferred construction material for a seal plate 36 is sheet metal, such as steel, or the like. In the case of a fill which is corrosive or reactive with metal, the interior surface portions of a container 20 and valve 21 can be coated with a suitable barrier layer (not shown) as those skilled in the art will appreciate. When coated surfaces are employed, care needs to be exercised to be sure that adequate sealing is obtained between the bonding means 38 and the surface of plate 36 and projections 37.

When, for example, the cup 29 and the seal plate 36 are comprised of steel, the bonding means 38 can be, for examples, one derived from: (a) a thermoplastic adhesive film (such as "Scotchweld" film 1460 from 3M Co., St. Paul, Minn., presently preferred; or dry film T-1502, which is presently understood to be a polyester film coated with a thermoplastic adhesive, from Sheldahl Co., Northfield, Minn.; or the like); (b) a thermosetting film (such a dry film T-1401, which is understood to be a thermosetting adhesive from Sheldahl Co.), so-called instant bonding, initially liquid adhesives (such as a so-called anaerobic adhesive like "Loctite Superbonder" 430; or "Loctite" 242 adhesive from Loctite Corporation, Newington, Conn.; or a cyanoacylate type adhesive such as is available from, for example, Eastman Chemical Co. of Rochester, N.Y. or the like); (c) a hot melt adhesive (such as "Dorex" side seam cement no HMP-8306 from W. R. Grace & Co., Dewey and Almy Chemicals Division, Atlanta, Ga., which is an initially solid material that is melted at about 360° F. and applied as a liquid to at least one of the two surfaces to be bonded together; and the like); and the like. When using an adhesive film, it is presently preferred to prepare a laminate-type assembly of the two components to be bonded together after which an exposed metal surface of one of the components is spot heated, or the like, by a localized heat source to a temperature at least sufficient to effectuate a bonding of metal-to-film-to-metal.

As those skilled in the art will appreciate, the internal diameter of the aperture 27 defined by the rolled perimeter 22 is typically standardized in the valve trade while the conventional mounting cup 29 is so formed as to have an inner wall member 39 integrally formed with the projections 37 which wall member 39 can have a diameter and an axial length as particularly chosen for an individual type of valve structure 21 desired.

Through the base 33 of central portion 35 and along the axis 40 of the mounting cup 29 is an aperture 42 which can be optionally provided as in valve assembly 21 with an upstanding lip 41 which serves as a stiffening or reinforcing means about the aperture 42. Through the aperture 42 is extended a nozzle stem member 43 which, at its upper end portion, is provided with a dispensing orifice 44, and which, at its opposite input end portion, is provided with a radially outwardly extending flange 45 that is here integrally formed with the nozzle stem member 43. The nozzle stem member 43 extends also through a central aperture 46 of a resilient elastomeric gasket 47 which gasket 47 also makes abutting contact with both adjacent outer wall portions of the nozzle stem member 43 and the flange 45. The outer perimeter of the gasket 47 is seated in the central portion 35 adjacent base 33 of the mounting cup 29. The nozzle stem member 43 is normally in the upright (valve closed) configuration illustrated in FIG. 2.

A moveable cup member 48 is disposed for axial sliding movements in the region of the central portion 35 of the mounting cup 29. The moveable cup member 48 includes a valve plate 51 which transversely (relative to nozzle stem member 43) extends across flange 45. Plate 51 further includes adjacent its outer periphery an integrally formed associated axially upstanding rib portion 52 which annularly extends about the valve plate 51. The rib portion 52, when the valve structure 21 is in its closed configuration as shown in FIG. 2, makes a seating engagement with adjacent portions of the gasket 47.

Also, integrally associated with the valve plate 51, are a plurality of radially (relative to plate 51) outwardly extending guide ribs 53 which are configured so as to be equally sized and equally circumferentially spaced from one another, and the radially outer edges of each rib 53 are in a spaced, adjacent, or even optionally contacting, slidable relationship with respect to adjacent portions of wall 39. In the embodiment shown, the guide ribs 53 extend axially downwardly (towards chamber 34) and rearwardly away from the valve plate 51 to an extent sufficient to stabilize sliding movements of the moveable cup member 48 relative to the mounting cup 29 and prevent cocking of valve plate 51.

Similarly downwardly and rearwardly extends a circumferentially continuous apron 55 integrally from valve plate 51 in a radially inwardly spaced relationship relative to the outer edges of ribs 53. The principal purpose of this apron 55 is to provide support and a point of attachment for the adjacent radially inner terminal portions of individual ribs 53, thereby to provide a reinforcing means for the ribs 53 and the plate 51 in the moveable cup member 48.

Diametrically across interior regions of the apron 55 a pair of integrally formed reinforcing ribs 56 are provided, the ribs 56 here extending perpendicularly to one another. In the region 57 of intersection of ribs 56, an axially extending projection or extension 58 is provided which extends rearwardly and downwardly (relative to gasket 47 and nozzle stem member 43). A perforating needle 59 is mounted axially in the extension 58 and projects rearwardly from the end of the extension 58 towards the seal plate 36. A minimal but spaced relationship is provided between the end of needle 59 and the surface of the seal plate 36.

As those skilled in the art will appreciate in the assembled combination of valve 21 and container 20 shown in FIG. 3, for example, the seal plate 36 is stabilized in relation to projections 37 and bonding means 38 by the internal pressures existing in the filled container 20, and there is substantially no possibility of desealing occurring from slight jarring or vibrations of the type which could be sufficient to rupture a thin, brittle, frangible, plastic disc, for example.

The assembled combination of valve 21 and container 20 is adapted for the receipt and storage of either a conventionally pressurized (e.g. about 35 to 40 pounds per square inch) fill or of a highly pressurized (e.g. about 150 psi) fill. This combination is particularly advantageous in the case of highly pressurized systems because of the advantageous circumstance that the sealed configuration shown in FIG. 2 can be altered in stages in an initial desealing operation as will now be described. Thus, in a first desealing stage, the valve stem 43 is manually tilted near orifice 44 which causes flange 45 to cammingly engage plate 51 and thereby slidably move the valve cup 48 downwards and rearwardly away from gasket 47. As this movement occurs, the needle 59 first contacts plate 36 and then penetrates same. Particularly if, at this time, the stem 43 is returned to its normally upright position, so that the needle 59 is removed or loosened relative to the perforation (not detailed) in plate 36, the pressures in the region 61 above plate 51 and below gasket 47 are now equalized. When the pressures are equalized, then the next or second stage of desealing can be carried out without having to overcome the pressure in chamber 34 by a tilting force exerted on valve stem 43.

Thereafter, in such second and final desealing stage, the valve stem 43 is manually tilted to an extent sufficient to cause the exposed end of extension 58 to bear against plate 36 and tilting angle of stem 43 is increased until, in effect, the pressure exerted against plate 36 through extension 58 is sufficient to release bonding means 38 so that the plate 36 can be separated from projections 37, thereby unsealing the valve 21.

With valve 21 thus unsealed, since an external deflecting force is applied against the outer or tip end 44 of stem 43, and the flange 45 is moved against valve plate 51, and the moveable cup member 48 is caused to be slidably moved away from gasket 47 and rib portion 52 is separated from gasket 47, the valve structure 21 is in an open configuration. In such valve open configuration, the pressurized contents in the container 20 flow into the interior region of stem 43 through the passageways 54 existing between circumferentially adjacent ribs 53 and radially adjacent portions of wall 39 and apron 55 and out through orifice 44.

As those skilled in the art will appreciate, the valve structure 21 in its open configuration provides a cross-sectionally exceedingly large flow capacity therethrough. Valve structure 21 is well adapted for the dispensing of viscous fluids.

When closure of valve structure 21 is desired, the tip end 60 is allowed to return to its normally upright configuration which effects a reversal of the valve opening operations described above and results in a resealing between the rib portion 52 and the gasket 37, with resealing being effectuated, in the valve structure 21, by the interior pressure within the container 20.

Referring to FIGS. 4–7, there is seen another embodiment of a valve structure of the present invention which is herein designated in its entirety by the numeral 64. Components of valve structure 64 which are similar to corresponding components in valve structure 21 are similarly numbered but with the addition of prime marks thereto. The general structure and operation of valve structure 64 is similar to that of valve structure 21. The valve structure 64 is well suited for utilization with the conventional fill pressures of about 30 to 35 psi within chamber 34'.

In place of moveable valve cup member 48 as in valve structure 21, valve structure 64 employs moveable valve cup member 65 for axial sliding movement therewithin. The moveable cup member 65 includes an end plate 66 (comparable to valve plate 51), an integrally formed upstanding rib portion 67 (comparable to rib portion 52) annularly extending about end plate 66 adapted to make seating engagement with adjacent portions of gasket 47', radially extending guide ribs 68 (generally comparable to ribs 53), and apron 69 (comparable to apron 55). However, here one of the guide ribs 68A is provided with an integrally formed, downwardly depending, eccentric cam lobe 71 located adjacent the radially outer edge portion thereof.

Figure 5:
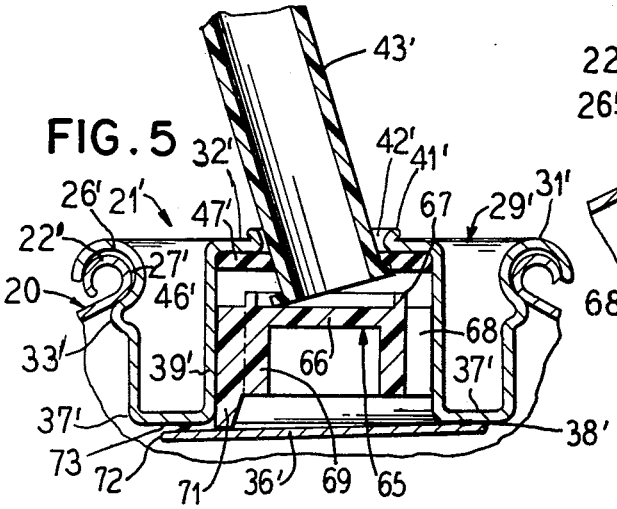
FIG. 5 is a view similar to FIG. 4, but illustrating the valve structure of FIG. 4 at the beginning of separation of the internal seal thereof.

When valve stem 43' is tilted into the configuration shown, for example, in FIG. 5, the lowermost tip portion of cam lobe 71 engages a surface portion of seal plate 36' in a region thereof which is in spaced, adjacent relationship to the outer edge 72' of seal plate 36', thereby to apply localized, downwardly exerted force against plate 36'. The result is that the bonding means 38' is locally separated or released, as shown in FIG. 5, as desired, in region 73.

Figure 6:
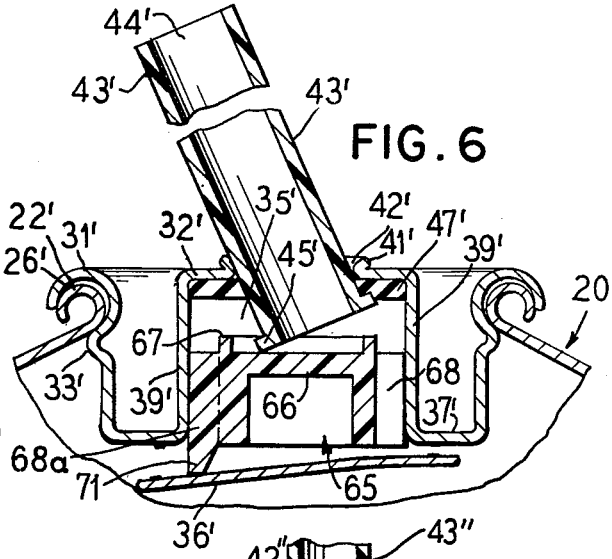
FIG. 6 is a further view of the valve structure of FIG. 4, but with the internal seal completely broken away.
Figure 7:
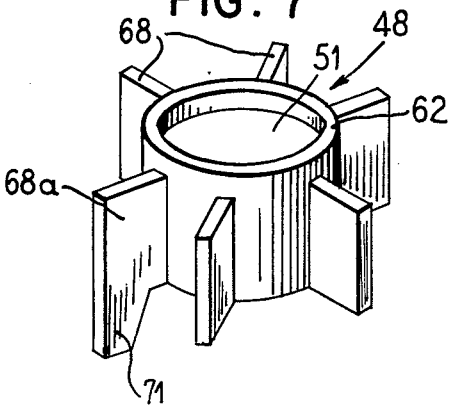
FIG. 7 is an isometric view of the moveable cup member employed in the valve structure of FIGS. 4–6.

As further tilting of valve stem 43' takes place, as illustrated in FIG. 6, the plate 36 is rapidly (relative to the extent of additional movement of stem 43') separated completely from association with projections 37' and the desealing operation is complete.

Figure 8:
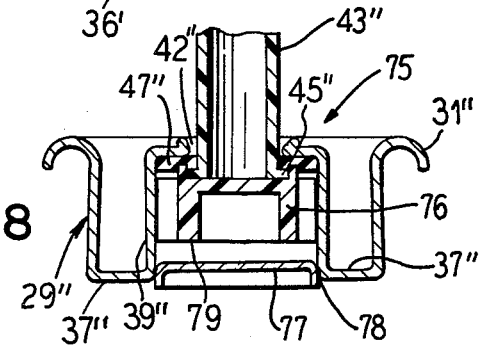
FIG. 8 is a vertical sectional view similar to FIG. 4, but illustrating a further embodiment of a valve assembly of the present invention.

Referring to FIG. 8, there is seen an (unmounted) valve assembly of the present invention herein designated in its entirety by the numeral 75 wherein components similar to the components in the valve assembly 21 are similarly numbered but with the addition of double prime marks thereto. The general structure and operation is comparable to that of valve structure 21.

In valve assembly 75, a rib equipped moveable cup 76 is incorporated which incorporates an apron 79 as an element for contact with a sealing plate 77. The region between peripheral edge portions of the gasket 77 and the projections 37'' which are adjacent one another is occupied by a resilient gasket member 78 which provides the releasable bonding means and which is adapted to provide a gas tight barrier across projections 37 (in combination with the associated sealing plate 77). In operation, the valve stem 43'', when tilted, moves the moveable cup 76 into abutting engagement with the sealing plate 77 to dislodge the sealing plate 77 from the projections 37'' and thereby deseal and separate plate 77 from cup 29''.

Figure 9:
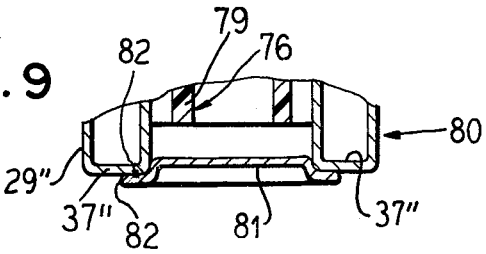
FIG. 9 is a fragmentary vertical sectional view of a valve assembly similar to that shown in FIG. 8, but illustrating an alternative structure for an internal seal means of the present invention.

Referring to FIG. 9, there is seen a further embodiment of a valve assembly of the present invention herein designated in its entirety by the numeral 80. Assembly 80 is generally similar to the valve assembly 75, and components thereof are thus correspondingly numbered, except that here a different structure is utilized for the sealing plate, the sealing plate here being designated by the numeral 81. A line weld 82 provides the releasable bonding means and annularly extends around the region between abuttment of plate 81 with projections 37'' to achieve a gas tight seal as desired between plate 81 and projections 37''.

Figure 10:
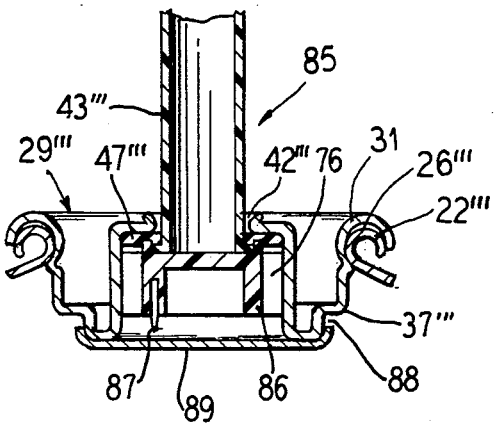
FIG. 10 is a vertical sectional view similar to FIG. 4, but illustrating a further alternative embodiment of a valve structure of the present invention.

Referring to FIG. 10, there is seen a further embodiment of the valve structure of the present invention herein designated in its entirety by the numeral 85 wherein components which are similar to components of valve structure 21 are similarly numbered but with the addition of triple prime marks thereto. The general structure and operation is comparable to that of valve structure 21. The moveable cup 76 employed in this embodiment is comparable to cup 76 as employed in the valve structure 75 except that here the apron 86 thereof is provided with an embedded, off-center, axially extending perforating needle 87. In this valve structure 85, the perforating needle 87 permits pressure equalization to be obtained in the initial valve desealing operation to facilitate release of the bonding means 88 and separation of plate 89 from projections 37″. Suitable bonding means 88 may here be provided by solder or by organic adhesive located adjacent the up-turned perimeter of the sealing plate 89.

Figure 11:
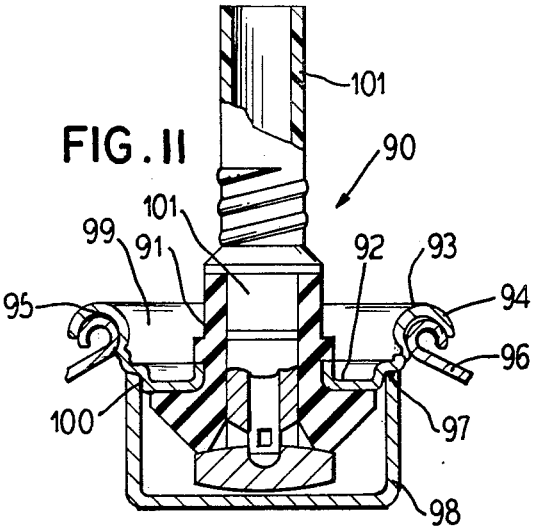
FIG. 11 is a vertical sectional view of an alternative embodiment of a valve structure of the present invention.
Figure 12:
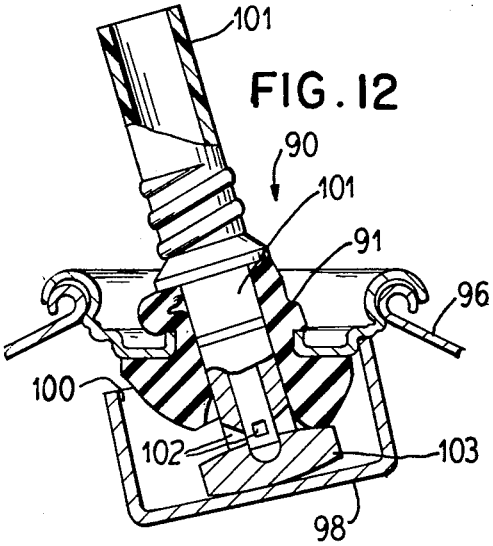
FIG. 12 is a vertical sectional view of the valve structure of FIG. 11, but illustrating the initial seal removing operation at the commencement of valve usage.

Referring to FIGS. 11 and 12, there is seen another type of valve assembly (compared to the valve assembly types shown in the proceeding FIGS. 2–10) which valve assembly is designated in its entirety by the numeral 90. The valve assembly 90 incorporates a conventional type of elastomeric, resilient tubular sealing plug 91 which extends through an aperture 92 centrally formed in a metallic cup-like valve body 93. The peripheral edge regions of the valve body 93 are formed into a rolled lip 94 whose interior surface portions are provided with an elastomeric sealing layer 95 so that the rolled lip can be conventionally mounted over mating portions across the mouth 99 of a dispensing container 96 with collet fingers. Radially adjacent the tubular sealing plug 91 is a circumferentially extending offset 97 formed in the valve body 93.

A generally cup shaped sealing plate 98 is fitted over integrally exposed components of the valve assembly 90 associated with cup body 93 and the rim portions of the plate 98 are releasably bonded in gas-tight relationship to adjacent portions of the body 93 in the region of offset 97 by bonding means 100, the bonding means 100 in composition being, for example, an organic or inorganic adhesive composition, or the like, as desired.

In normal (unsealed) operation of valve assembly 90, when the stem 101 of the valve assembly 90 is tilted, for example, into a configuration such as illustrated in FIG. 12, the sealing plug 91 is distorted and the access ports 102 formed in the lower portions of the valve stem 101 are exposed, thereby permitting the fill within a container 96 or the like to enter ports 102 and to be dispensed through the hollow interior of stem 101.

In the valve structure 90 to accomplish unsealing in initial valve operation, the valve stem 101 is tilted causing the valve head 103 to be brought into abutting engagement with the interior bottom surface of the sealing plate 98. With increasing tilting of the stem 101, there is developed the sufficient pressure needed to break the bonding means 100 between the rim portions of the sealing plate 98 and the valve body 93 in the region of offset 97 resulting in the separation of the sealing plate 98 from the valve body 93, the desealing operation being shown, for example, in FIG. 12.

Figure 13:
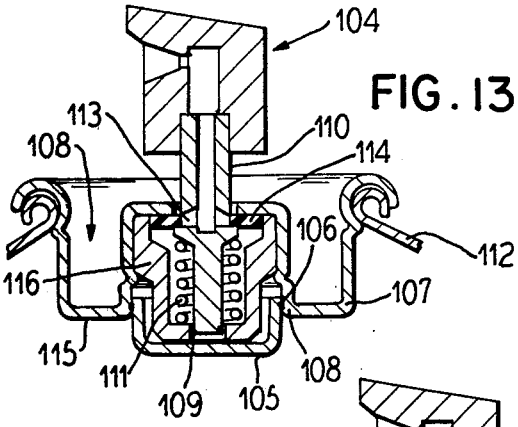
FIG. 13 is a vertical sectional view of an alternative embodiment of a valve structure of the present invention.

Referring to FIG. 13, there is seen another type of valve assembly (compared to the valve assembly types of FIGS. 2–12) which valve assembly is herein designated in its entirety by the number 104. Valve assembly 104 is of the type wherein, when the valve stem assembly 110 is vertically depressed against principally the yielding bias of a spring 111, there is opened a flow path for a pressurized fill being dispensed (from a container 112 with which the cup 108 of the valve 104 is attached) through valve body 116 from fill entry port 109 to a plurality of exposed to access ports 113 in valve stem assembly 110, the sealing gasket 114 normally covering the ports 113 when the valve assembly 104 is in its closed configuration as shown in FIG. 13. By the present invention, valve assembly 104 is provided with an interior cup-shaped sealing plate member 105 which is releasably bonded to projections 115 of mounting valve cup 108 by a bonding means 106 which initially secures peripheral portions of the sealing plate 105 to adjacent portions of projections 115. With initial downward movement of the valve stem 110 axially, the bonding means 106 is released to remove the sealing plate 105 and thereby permit the normal operation of valve assembly 104 to take place for fill dispensing operations.

Figure 14:
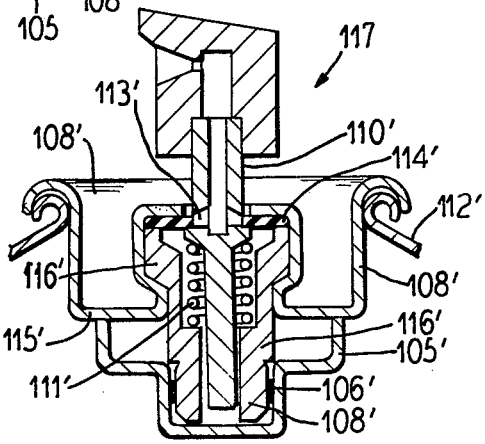
FIG. 14 is a view similar to FIG. 13, but illustrating an alternative embodiment of such valve structure.
Figure 15:
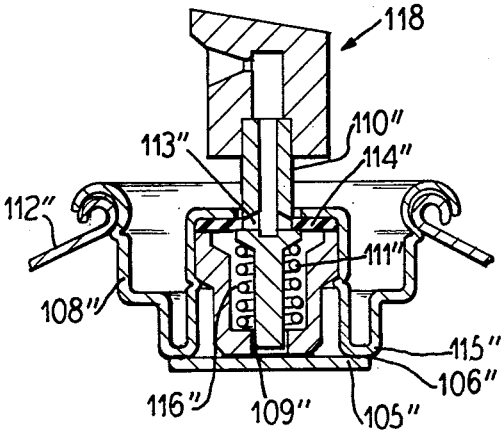
FIG. 15 is a view similar to FIG. 13, but illustrating an alternative embodiment of such valve structure.
Figure 16:
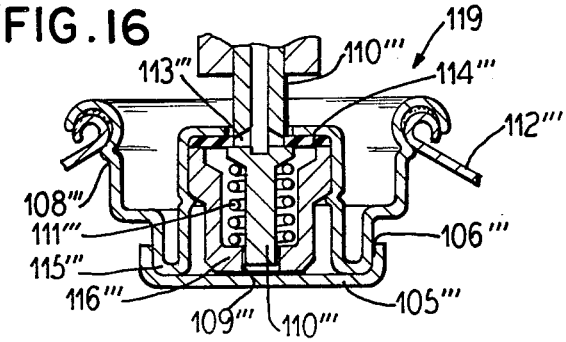
FIG. 16 is a view similar to FIG. 13, but illustrating an alternative embodiment of such valve structure.

In each of FIGS. 14, 15, and 16, are shown respectively, modified forms of the valve structure 104, each such modified form being identified, respectively, by the numerals 117, 118, and 119. Components of each of valve structures 117, 118, and 119 are similarly numbered to the corresponding components in valve structure 104 but with the addition thereto of prime, double prime, and triple prime marks, respectively. The general structure and operation of each of valves 117, 118, and 119 is comparable to that of valve 104.

In the case of valve structure 117, the sealing plate 105′ is configured so as to permit same to be in a spaced parallel relationship to terminal circumferential side wall portions of valve body 108′ so as to permit bonding means 106′ to be positioned between and adjoining the sealing plate 105′ and the valve body 108′. When, during the initial desealing operation, the stem 110′ is depressed, a shearing stress is exerted against the bonding means 106 to achieve release thereof as desired. Optionally, a gasket (not shown) can be positioned between rim portions of the sealing plate 105′ and adjacent projections 115′ of valve cup body 108′. A similar type of shear force for achieving release of bonding means 106‴ in valve 119 to that attained in valve assembly 104 with respect to bonding means 106 is developed when valve stem 110‴ is depressed in valve 119. Tensile stress is employed in valve structure 118 to release bonding means 106″ and thereby separate projections 115″ from sealing plate 105″.

Figure 17:
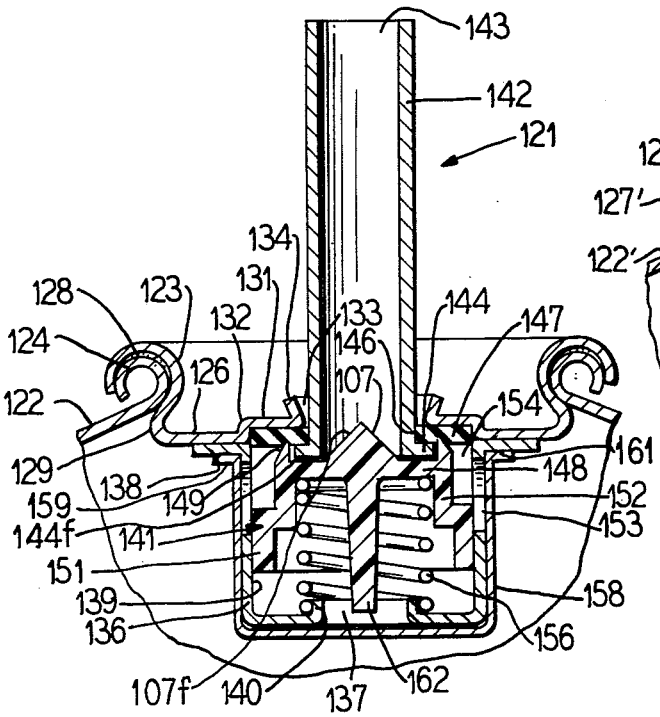
FIG. 17 is a view similar to FIG. 2, but illustrating an alternative embodiment of a valve structure of the present invention.

Referring to FIG. 17, there is seen an alternative embodiment of a tiltable valve structure of the present invention, such structure being identified in its entirety by the numeral 121. Valve structure 121 is particularly well adapted for combination with an aerosol-type conventional dispensing container 122 which is provided with an axially located aperture 123 having a rolled perimeter 124, the container 122 being formed preferably in this instance of sheet metal.

The tilt valve structure 121 includes a metallic mounting plate 126 which terminates in a rolled perimeter 127 that is adapted to make nesting engagement with the rolled perimeter 124. Interior surfaces of the rolled perimeter 127 are provided with a coating 128 formed of a sealing material comprised of a resilient elastomeric plastic composition, such as chloroprene rubber or the like, so that, when the mounting plate 126 is fitted over the rolled perimeter 124 and crimped thereto by collet fingers, there is produced a retaining crimp 129 in plate 126 and the preformed valve structure 121 is thus sealingly associated with the container 122.

The central portion of the mounting plate 126 is provided with an integrally formed cover plate region 131 which includes a raised rim 132 and a centrally defined aperture 131 which includes a raised rim 182 and a centrally defined aperture 133 which has circumferentially defined an upwardly and outwardly formed rigidifying flange 134. Depending from the mounting plate 126 in aligned relationship to the cover plate region 131 is a cross-sectionally tubularly shaped cup member 136 that is provided with an out-turned rim flange 138 which is secured in face-to-face engagement with the interior or bottom face of the plate 126 by means of welding, adhesive, or the like, as desired. The internal central bottom face of the cup member 136 is provided with an aperture 137 equipped with an in-turned rim flange 140.

Figure 4:
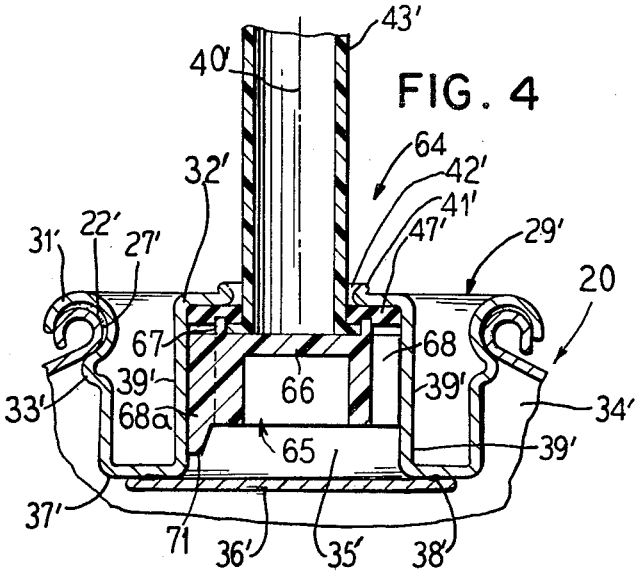
FIG. 4 is a view similar to FIG. 2, but illustrating an alternative embodiment of a valve structure of the present invention.

Disposed for axial sliding movements within the tubular side wall portions 139 of the cup member 136 is a moveable cup member 141. Through the aperture 133 of the plate region 131 is extended a nozzle stem member 142 which at its upper end portion is provided with a dispensing orifice 143 and which at its opposite end portion is provided with a radially outwardly extending flange 144 that is here integrally formed with the nozzle stem member 142. The nozzle stem member 142 extends also through a central aperture 146 of a resilient elastomeric gasket 147 which gasket 147 also makes abutting contact with both adjacent outer wall portions of nozzle stem member 142 and the flange 144. The outer perimeter of the gasket 147 is seated in the central portion of the mounting cup 136. The nozzle stem member 142 is in a normally upright configuration as illustrated in FIG. 4.

The moveable cup member 141 includes a base plate 148 which transversely (relative to nozzle stem member 142) extends across the flange 144 and further includes, adjacent the outer periphery of the base plate 148, an integrally formed upstanding rib portion 149 which annularly extends about the base plate 148. The rib portion 149, when the valve structure 121 is in its closed configuration as shown in FIG. 4, makes a seating engagement with adjacent portions of the gasket 147.

Also, the moveable cup member 141 is provided with a circumferentially extended skirt portion 151 which is adapted to make slidable guiding contact with the tubular wall portions 139, the axial length of the skirt 151 being sufficient to provide a stabilized reciprocal sliding ability for the moveable cup 141 relative to the cup 136. The upper regions of the skirt 151 are integrally associated with the circumferentially outer portions of the plate 148 by means of an interconnecting sleeve 152 integrally formed therewith. The exterior diameter of the sleeve 152 is smaller than the exterior diameter of the skirt portion 151. The sleeve 152 thus provides an annularly disposed chamber about the outside region thereof which is located within the cup 136 in the region of aperture 153 defined in the cup 136 near the mouth 154 thereof. Thus, a pressurized fill within a container 122 is in close proximity to the rib portion 149 and the port formed between the flange 144 and the rib portion 149 when the nozzle stem member 142 is in its tilted (valve open) configuration.

In order to enhance valve closing capabilities following a valve opening, a coil spring member 156 of the compression type is disposed within the moveable cup member 141 so that one end thereof butts the plate 148 while the other end thereof is retained adjacent the rim flange 140.

As an optional but preferred feature, the plate 148 is provided with a centrally located camming member 107 which is preferably integrally formed therewith. Thus, the plate 148 has a flat annular face **148*f* positioned peripherally about the camming member 157, such face 148*f* being adapted to extend generally parallel to the face 144*f* of flange 144. Observe that the face 144*f*, when the valve 121 is in its closed configuration shown in FIG. 4, is preferably in a spaced relationship to the face 148*f*. The face 107*f* of camming member 107 is inclined relative to the face 148, the angle of inclination relative to face 107*f* being generally greater than 0° and smaller than about 70° with a presently preferred such angle falling in the range from about 30° to 60°. This camming angle of inclination is generally one which will permit a transverse tilting motion of the nozzle stem member 142 (which motion occurs during opening and closing of the valve 121) to be converted into vertical movement of moveable cup member 141 with the position of the cup member being predictably determined by the position of the stem member 142 at any given time. The conical face 107*f* of camming member 107 cooperates with the flange face 144*f* of flange 144 to achieve a capability for maximum movement of the cup member 141 during a valve opening operation for a minimum angle of deflection or tilting for the nozzle stem member 142 during a valve opening operation. Thus, the location and configuration of the camming member 107 can be varied as desired for a particular use situation. The clearance between the apertures 153 and the sleeve 152 is not required in any given embodiment of a valve structure 121, but is desirable, it is now believed, in order to achieve a minimum flow pathway and a maximum aperture of valve opening during a valve dispensing operation for a valve structure 121. Observe that these advantages and features are achieved without any movement of container fill axially through the interior of the moveable cup member 141. The actual flow pathway of fluid being dispensed thus takes place primarily in a transverse (radial) direction and not in an axial direction relative to the moveable cup member 141 in a valve structure 121. The camming member 107** thus increases the valve aperture in a surprising and very effective manner.

A cup shaped sealing plate 158 with an out-turned rim portion 159 is nestingly fitted over the cup member 136 and the rim portion 159 is adapted to make abutting interfacial engagement with rim flange 138. A releasable bonding means 161 is interposed between rim portion 159 and rim flange 138 to provide the desired hermetic seal.

When the valve stem 142 is tilted initially, the end of axially extending prong 162, which rearwardly extends integrally from base plate 148 away from gasket 147, engages the inside bottom face of sealing plate 158 centrally, and the bonding means 161 is pressured sufficiently to release the plate 158 from cup 136, thereby opening the apertures 153 and permitting normal valve operation to occur.

Figure 18:
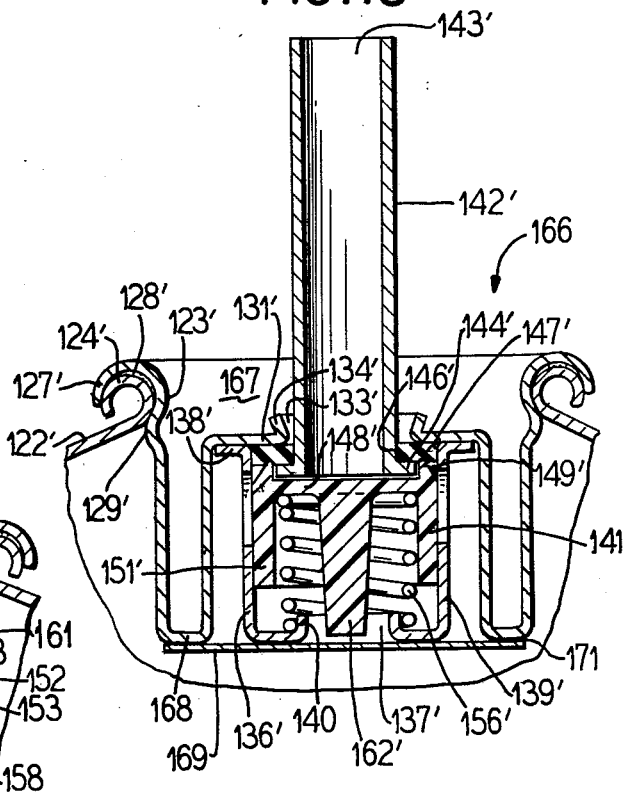
FIG. 18 is a view similar to FIG. 2, but illustrating an alternative embodiment of a valve structure of the present invention.

Referring to FIG. 18, there is seen a further valve assembly of this invention which is designated in its entirety by the numeral 166. Components of valve assembly 166 which are similar to those of valve assembly 121 are similarly numbered but with the addition of prime marks thereto. The structure and operation of valve assembly 166 is generally similar to that of valve assembly 121.

In valve assembly 166, a mounting plate 167 replaces plate 126 of valve 121, and plate 167 is formed to include a circumferentially extending, inwardly axially downwardly reaching projection 168 whose depth approximates that of the axial depth of cup 136'. A flattened disk-shaped sealing plate 169 is extended across projection 168 thereby completely covering the mid-region of valve assembly 166. The plate 169 is releasably secured to projection 168 by sealing means 171. Removal of plate 169 is achieved by initially tilting stem 142'.

The internal sealing means of the present invention comprising a sealing plate means and a releasable bonding means for initially bonding such sealing plate means to an initially adjacent (relative to such sealing plate means) portion of an associated valve body can be employed with any valve assembly wherein the releasable bonding means is separatable by a seal removing means which is externally (relative to the valve assembly and an associated container) operated. The seal removing means is operatable by linear-type movement of a valve stem functionality associated with the valve assembly.

One presently preferred class of valves from use in the practice of the present invention comprises valves having tiltable stem in combination with a moveable cup, particularly such valves of this type which have a high flow capacity such as are shown in FIGS. 2–10 and 17–18 and described. For additional valves of this general type, see the teachings of my copending U.S. patent application Ser. Nos. 394,517 filed July 2, 1982; 405,696 filed Aug. 5, 1982; 432,298 filed Oct. 1, 1982; and 438,212 filed Nov. 1, 1982; the disclosure of which is entirely incorporated hereinto by reference.

Although the teachings of my invention have herein been discussed with reference to specific embodiments, it is to be understood that these are by way of illustration only and that others may wish to utilize my invention in different designs or applications.

I claim:

1. In a fluid preassemblable valve structure of the type suitable for dispensing the contents of a pressurized container associatable therewith, said valve structure comprising:

a valve mounting cup peripherally sealingly securable to said pressurized container and having generally continuous wall projections extending generally internally into said container and defining an interior valve receiving chamber with a medial upper portion having a central aperture defined therein;

an elongated tubular nozzle means having a dispensing orifice in one end thereof and having a second end extending through said central aperture;

a resilient valve seat means positioned in said valve receiving chamber;

a moveable valve means positioned in said valve receiving chamber and biasable against said valve seat means to close and seat said valve structure;

said tubular nozzle means being moveable responsively to force applied to said one end so that said second end unseats said moveable valve means to open said valve structure;

the improvement which comprises in combination:

a sealing plate means positioned across said wall projections and closing said valve receiving chamber;

a releasable bonding means adhering said sealing plate means to adjacent portions of said wall projections in gas tight relationship, and adapted to release said sealing plate means from said wall projections responsively to pressure applied against said sealing plate means from a location in said valve receiving chamber;

said sealing plate means and said bonding means in combination with said wall projections being effective to isolate said contents from said tubular nozzle means, said valve seat means, and said moveable valve means, engaging means associated with said moveable valve means for abutting against said sealing plate means; and the interrelationship between said sealing plate means, said tubular nozzle means, said moveable valve means, and said releasable bonding means being such that an initial movement of said tubular nozzle means moves said moveable valve means with said associated engaging means against said sealing plate means to permit a release of said bonding means and a separation of said sealing plate means from said wall projections, thereby to permit operable association between said contents and said valve structure for dispensing said contents.

2. The dispensing valve structure of claim 1 wherein said bonding means comprises an adhesive composition.

3. The dispensing valve structure of claim 1 wherein said bonding means comprises a gasket which initially frictionally adheres said sealing plate to said wall projections in an adjacent relationship.

4. The dispensing valve structure of claim 1 wherein said engaging means is disposed to centrally so abutt against said sealing plate.

5. The dispensing valve structure of claim 1 wherein said engaging means is disposed to so abutt against said sealing plate adjacent a periphery thereof.

6. The dispensing valve structure of claim 1 wherein said resilient valve seat means comprises an elastomeric tubular plug which extends through said central aperture circumferentially about said tubular nozzle means and said tubular nozzle means is integrally associated with said moveable valve means whereby, when said one end of said tubular nozzle means is tilted relative to said valve mounting cup, said tubular plug deforms and exposes aperture means defined in said moveable valve means, thereby to permit flow of said contents through said valve receiving chamber and said tubular nozzle means, and said engaging means is located at an innermost end portion of said moveable valve means.

7. The dispensing valve structure of claim 1 wherein said resilient valve seat means comprises gasket means circumferentially disposed about said tubular nozzle means, said tubular nozzle means is integrally associated with said moveable valve means, and said tubular nozzle means is longitudinally reciprocable whereby, when said one end of said tubular nozzle is depressed towards said valve mounting cup, aperture means defined in said moveable valve means are exposed, thereby to permit flow of said contents through said valve receiving chamber and said tubular nozzle means, and said engaging means is located at an innermost end portion of said moveable valve means.

8. The dispensing valve structure of claim 1 wherein said sealing plate is positioned across terminal portions of said wall projections.

9. A device for dispensing a highly viscous liquid comprising:

(A) a pressurizable container, and (B) a fluid dispensing valve structure of claim 1.

10. The dispensing valve structure of claim 1 wherein said sealing plate means is cup-shaped.

11. The dispensing valve structure of claim 1 wherein said sealing plate means is flattened.

12. The dispensing valve structure of claim 1 wherein said bonding means comprises a metal.

13. The dispensing valve structure of claim 12 wherein said metal is a weld.

14. The dispensing valve structure of claim 12 wherein said metal is a solder.

15. The dispensing valve structure of claim 1 wherein said moveable valve means comprises a moveable cup that is slidably longitudinally reciprocal within portions of said valve receiving chamber responsively to tilting movements of said one end of tubular nozzle means, and said resilient valve seat means comprises gasket means circumferentially disposed about said tubular nozzle means whereby, when said one end is tilted relative to said valve body, said moveable cup is moved from said resilient valve seat means by said second end, thereby to permit flow of said contents through said valve receiving chamber and said tubular nozzle means, and said engaging means is integrally associated with said moveable cup.

16. The dispensing valve structure of claim 15 wherein said engaging means includes projection means associated with said moveable cup.

17. The dispensing valve structure of claim 16 wherein said projection means additionally is provided with piercing means adapted to penetrate said sealing plate when said engaging means moves against said sealing plate.

18. A fluid dispensing valve structure for dispensing the viscous contents of a pressurized container comprising:

a valve mounting cup member:

peripherally sealingly securable to said pressurized container, having generally continuous first wall portions defining a centrally located aperture, having a cup-like member with a mouth and generally continuous second wall portions defining sides and base, said cup-like member including fastening means mounting mouth adjacent second wall portions thereof circumferentially about said aperture, said base having an opening centrally defined therein;

a resilient seal member positioned radially adjacent said aperture interiorly of said cup-like member, an elongated tubular nozzle means having a dispensing opening in one end thereof and having a second opposed and outwardly flanged end supported relative to said valve mounting cup member by said resilient seal member in a normally generally straight upright extended position;

a moveable valve cup member reciprocally longitudinally slidably moveable within said cup-like member and normally biasable against said resilient seal member to form a seal means for normally sealing the contents of said container, said moveable valve cup member being engageable with said second end, said contents of said pressurized container being dispensable when one end is tiltably displaced relative to said generally straight upright extended position by an external deflecting operating force applied thereagainst, thereby opening said seal means, said moveable valve cup member including:

(A) a base portion extending across said second end of said tubular nozzle means, (B) annular rib means upstanding from said base portion for engaging said resilient seal member peripherally of said second end, (C) guidance means for guiding said moveable valve cup member relative to said cup-like member during said reciprocal sliding movements, and (D) projections means for extension through said opening during said reciprocal sliding movements;

aperture means defined in said sides axially adjacent said resilient seal member for passage of said contents therethrough to said second end in a generally radial and transverse direction relative to said sides;

a sealing member positioned over areas of said first and said second wall portions including said aperture means;

releasable bonding means adhering portions of said sealing member to areas of said wall portions in a gas tight sealing relationship, said bonding means being adapted to release said sealing member from said wall portions responsively to pressure applied against a portion of said seal member by said projection means;

said sealing member and said bonding means in combination with said wall portions being effective to isolate said contents from said tubular nozzle means, said resilient seal member, and said moveable valve cup member;

the interrelationship between said sealing member, said tubular nozzle means, said moveable valve cup member, and said releasable bonding means being such that an initial movement of said tubular nozzle means moves said moveable valve cup member with said associated engaging means against said sealing member to permit a release of said bonding means and a separation of said sealing member from said wall portions, thereby to permit operable association between said contents and said valve structure for dispensing said contents; and the interrelationship between said moveable valve cup member, said tubular nozzle means, said resilient seal member, said mounting cup member and said sealing member being such that a substantially unobstructed flow of said contents through said valve structure and into said second end occurs when said one end is so tiltably displaced and said sealing member is so separated from said wall portions.

19. The valve structure of claim 18 additionally including retaining means which limits extent of such slidability of said moveable valve cup member relative to said mounting cup member away from said resilient seal member.

20. The valve structure of claim 18 additionally including spring means urging formation of said seal means, said spring means extending between said base and said moveable cup member.

21. A fluid dispensing valve structure for dispensing viscous fluid contents of a pressurized container comprising:

a valve mounting cup peripherally sealingly securable to said pressurized container and having an aperture defined therein, and having generally continuous side wall portions extending interiorly into said container;

a resilient seal member carried within said valve mounting cup and radially adjacent said central aperture;

an elongated tubular nozzle means extending through said central portion and having an exterior dispensing orifice in one end thereof and having an interior second end, said nozzle means being yieldingly supported by said resilient seal member in a normally generally straight upright extended position;

a moveable valve cup member reciprocally longitudinally slidably carried within said side wall portions and normally biasable against said resilient seal member to form a seal means for normally sealing the contents of said container, said moveable valve cup member being engageable with said second end, said contents of said pressurized container being dispensable when said one end is tiltably displaced relative to said upright extended position by an external deflecting operating force applied thereagainst, thereby opening said seal means, said moveable valve cup member including:

(A) a base portion extending across said second end of said tubular nozzle means, (B) rib means upstanding from said base portion for engaging said resilient seal member peripherally of said tubular nozzle means, and (C) guidance means for orienting and moving said moveable valve cup member relative to said side wall portions during said reciprocal sliding movements longitudinally relative to said mounting cup member;

channel means defined by said side wall portions and said moveable valve cup member when said one end is so tiltably displaced for a flow of said contents therethrough;

a sealing plate means centrally positioned across said side wall portions;

releasable bonding means adhering said sealing plate means to said side wall portions in gas tight relationship, and adapted to release said sealing plate from said side wall portions responsively to pressure applied against a portion of a face thereof adjacent said moveable valve cup member;

said sealing plate means and said bonding means in combination with said side wall portions being effective to isolate said contents from said tubular nozzle means, said resilient seal member, and said moveable valve cup member;

engaging means associated with said moveable valve cup member for abutting against a portion of said sealing plate;

the interrelationship between said sealing plate, and tubular nozzle means, and said moveable valve cup member, and said releasable bonding means being such that an initial movement of said tubular nozzle means moves said moveable valve cup member with said associated engaging means against said sealing plate means to permit a release of said bonding means and a separation of said sealing plate means from said wall projections, thereby to permit operable association between said contents and said valve structure for dispensing said contents; and the interrelationship between said moveable valve cup member, said tubular nozzle means, said resilient seal member, and said mounting cup member being such that a substantially unobstructued and non-turbulent flow of said contents through said valve structure can occur when said one end is so tiltably displaced and when said sealing plate means is so separated from said side wall projections.

22. The valve structure of claim 21 wherein said channel means has as effective cross-sectional area which is at least equal to the effective cross-sectional area of said tubular nozzle means.

23. The valve structure of claim 21, so secured to said pressurized container and wherein said pressurized contents provide yielding biasing means urging formation of a seal between said resilient seal member and said moveable valve cup member.

24. The valve structure of claim 21 wherein a plurality of second rib means extends from said base portion away from said resilient seal member along said cup member to a distance at least sufficient to avoid any appreciable cocking of said moveable valve cup member relative to said mounting cup member.

25. The dispensing valve structure of claim 21 wherein said aperture means is defined in said side wall portions axially adjacent said resilient seal member and is adapted for passage of said contents therethrough to said second end in a generally radial direction relative to said side wall portions.

26. The valve structure of claim 21 further including camming means centrally upstanding from said base portion and slidably engageable with portions of said second end of said tubular nozzle means when said one end is so tiltably displaced, whereby deflection of said moveable valve cup member occurs when said second end slides therealong.

27. A device for dispensing a highly viscous liquid comprising:

(A) a pressurizable container, (B) a fluid dispensing valve structure secured to said container and having fluid communication with the interior thereof, said valve structure being as described in claim 21.

28. The valve structure of claim 24, wherein said moveable cup member further includes integral support means extending from said base portion for rigidifying said plurality of second rib means.

29. The valve structure of claim 28 wherein said support means comprises a collar interconnected to said base portion and to interior ends of each of said plurality of second rib means.

30. The valve structure of claim 28 wherein said support means comprises the interconnected interior ends of each of said plurality of second rib means.

* * * * *